United States Patent [19]

Kurple

[11] Patent Number: 5,034,094

[45] Date of Patent: Jul. 23, 1991

[54] METHOD OF CONVERTING INORGANIC MATERIALS FROM KRAFT PULPING LIQUOR INTO PULPING CHEMICALS WITHOUT PASSING THEM THROUGH A RECOVERY FURNACE

[76] Inventor: Kenneth R. Kurple, 9533 Springborn Rd., Anchorville, Mich. 48004

[21] Appl. No.: 405,302

[22] Filed: Sep. 11, 1989

Related U.S. Application Data

[63] Continuation of Ser. No. 118,152, Nov. 6, 1987, abandoned.

[51] Int. Cl.[5] ..... D21C 11/00; D21C 11/12

[52] U.S. Cl. ..... 162/16; 162/30.11; 162/38

[58] Field of Search ..... 162/30.11, 16, 29, 30.1, 162/80, 38; 210/928; 423/DIG. 3

[56] References Cited

U.S. PATENT DOCUMENTS

| | | | |
|---|---|---|---|
| 3,986,923 | 10/1976 | Reeve | 162/30.11 |
| 4,470,876 | 9/1984 | Beaupré et al. | 162/30.11 |
| 4,507,172 | 3/1985 | Steltenkamp | 162/30.11 |

FOREIGN PATENT DOCUMENTS

| | | | |
|---|---|---|---|
| 730914 | 1/1978 | U.S.S.R. | 162/80 |

*Primary Examiner*—Steve Alvo

*Attorney, Agent, or Firm*—Woodling, Krost and Rust

[57] ABSTRACT

A process for increasing the pulp producing capacity of a kraft mill including the steps of removing at least a portion of the lignin from kraft black liquor and separating the lignin from the aqueous phase. The next step is treating the aqueous phase to separate the inorganics and organics with the organics preferably being recycled to the process loop to be burned in the recovery furnace. The inorganics are converted into pulping chemicals which bypass the recovery furnace and are transported to white liquor preparation.

13 Claims, 2 Drawing Sheets

METHOD OF CONVERTING INORGANIC MATERIALS FROM KRAFT PULPING LIQUOR INTO PULPING CHEMICALS WITHOUT PASSING THEM THROUGH A RECOVERY FURNACE

This is a continuation of Ser. No. 118,152 filed on Nov. 6, 1987, now abandoned.

At the present time the kraft pulping process contains a kraft recovery furnace which converts concentrated kraft black liquor into an inorganic ash which is then further chemically processed into caustic chemicals which are used to convert wood into pulp. Basically the kraft pulping process is a closed loop pulping process wherein the spent kraft liquor is used to produce the pulping chemicals that are used in the process. However, the kraft recovery furnace is usually the single most expensive piece of equipment at a kraft pulp mill. The cost of just one kraft recovery furnace is usually in excess of 100 million dollars. The capacity of a kraft recovery furnace limits the total pulp production of the kraft pulp mill. Even though the rest of the kraft pulp mill could produce more pulp it is the capacity of the kraft recovery furnace that determines how much pulp is produced. In some cases efforts are made that overload the recovery furnace; however, this occurs for only short periods of time and also could cause serious damage to the kraft recovery furnace thereby forcing a shutdown of the entire kraft pulp mill. This prevents kraft pulp mills from taking advantage of peak demands for pulp and paper which would substantially improve profits and return on investment. It is not economically feasible for a kraft pulp mill to install an additional kraft recovery furnace just to have excess capacity for peak demands because of the huge capital investment required. This approach would dramatically reduce profits and the return on investment.

The present invention discloses a new process that allows a kraft pulp mill to dramatically increase its production of pulp without overloading the kraft recovery furnace. In fact no additional kraft recovery furnace is required and therefore no new investment for a kraft recovery furnace is needed. This new process enables a kraft pulp mill to take advantage of peak demands for pulp and paper without the risk of overloading the recovery furnace. In addition, this new process provides the kraft pulp mill with additional revenue from by-products that were previously burned for their fuel value. This new process is able to accomplish this without interfering with the chemistry of the kraft pulping process. That is, no new chemicals or process chemistry is introduced into the kraft pulping process. This approach avoids any major investment that would be required to make such changes.

BRIEF DESCRIPTION OF THE DRAWINGS

FIG. 1 illustrates the conventional process flow diagram for the kraft pulping process. This is still the standard process for operating kraft pulp mills. In this diagram, it should be noted that the entire process stream, the concentrated kraft black liquor, is processed in the kraft recovery furnace to produce an inorganic ash which is further chemically processed into pulping chemicals.

The new process of the present invention (FIG. 2) may be considered basically a by-pass process wherein after the pulp has been removed a certain percentage of weak black liquor is removed from the process stream. The kraft lignin that is present in the kraft black liquor is removed from the process stream so that all that remains in the kraft black liquor are the wood sugars and other organics, organic acids and also the inorganic or organic anion from the acid that is used to acidify the kraft black liquor in order to remove the kraft lignin.

Once the kraft lignin has been removed, the residual liquor will contain sodium sulfate where sulfuric acid has been used to acidify the black liquor in order to remove the kraft lignin. Depending on the size of the kraft pulp mill, this sodium sulfate may be left in this residual liquor and concentrated and then burned in the kraft recovery furnace. This is because sodium sulfate is reduced in the recovery furnace to produce sodium sulfide which is one of the pulping chemicals. There is always a certain amount of sodium sulfate added to the kraft recovery furnace in order to maintain a sodium sulfide balance. Therefore the presence of a certain amount of sodium sulfate in this residual liquor may be tolerated with no problems. However, once the maximum amount of sodium sulfate has been reached it becomes necessary to remove the sodium sulfate from the residual kraft liquor stream by various means. The simplest method is to concentrate the residual stream and then allow the sodium sulfate to crystallize and then physically separate the sodium sulfate crystals. The rest of the filtrate is concentrated and then burned in the kraft recovery furnace. At this point the separated sodium sulfate crystals may be sold as an item of commerce. Under these circumstances, other sodium compounds would have to be added later in the process stream in order to maintain the sodium balance of the system. However, it is one of the major advantages of this invention to convert this excess sodium sulfate into a caustic pulping chemical such as sodium hydroxide or sodium carbonate. Not only does this approach bypass the recovery furnace but also several other steps in the processing of the ash from the recovery furnace.

Figure 1:
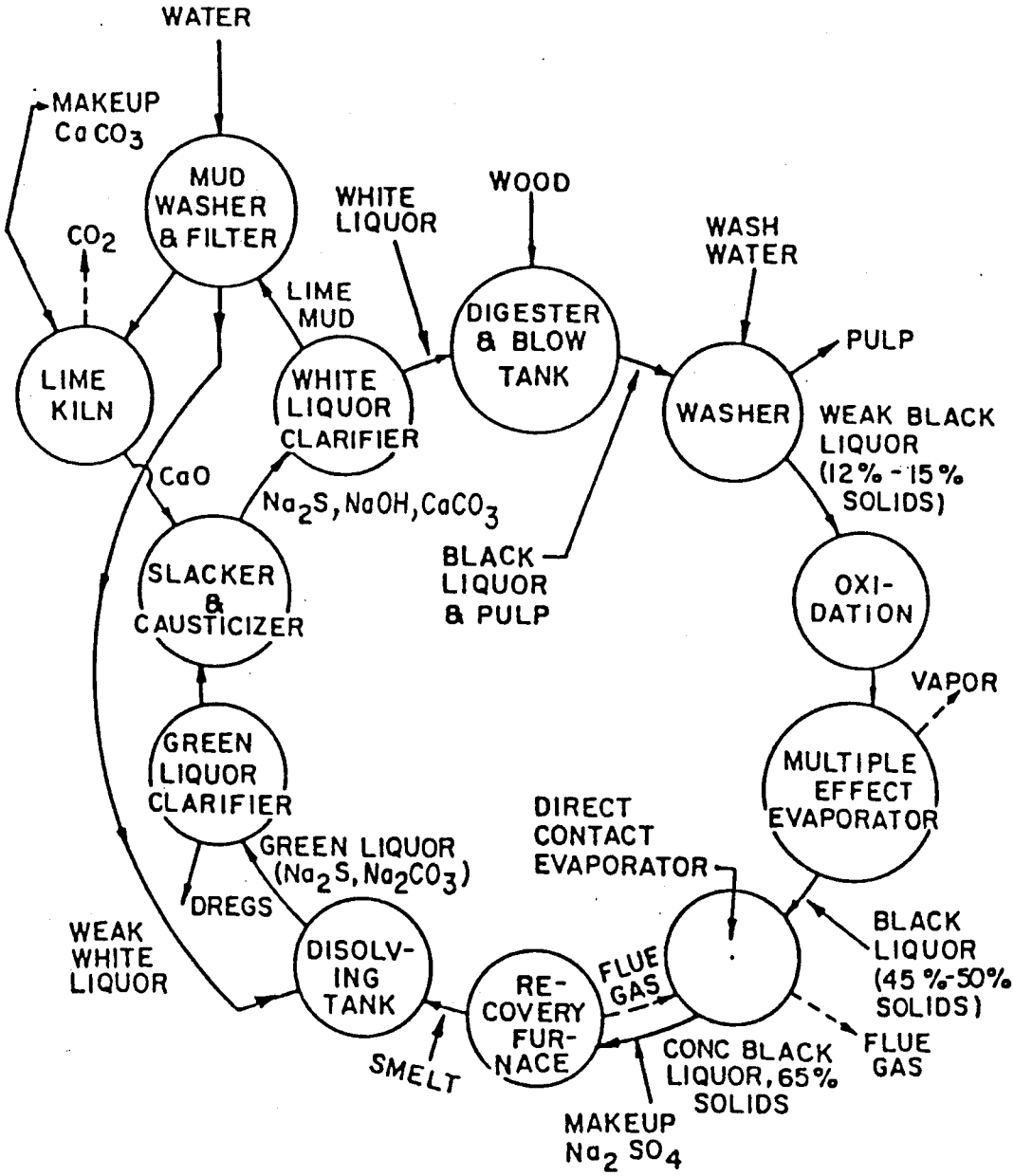
FIG. 1 PRIOR ART
FIG. 1 illustrates a flow diagram of a conventional kraft pulping process.
Figure 2:
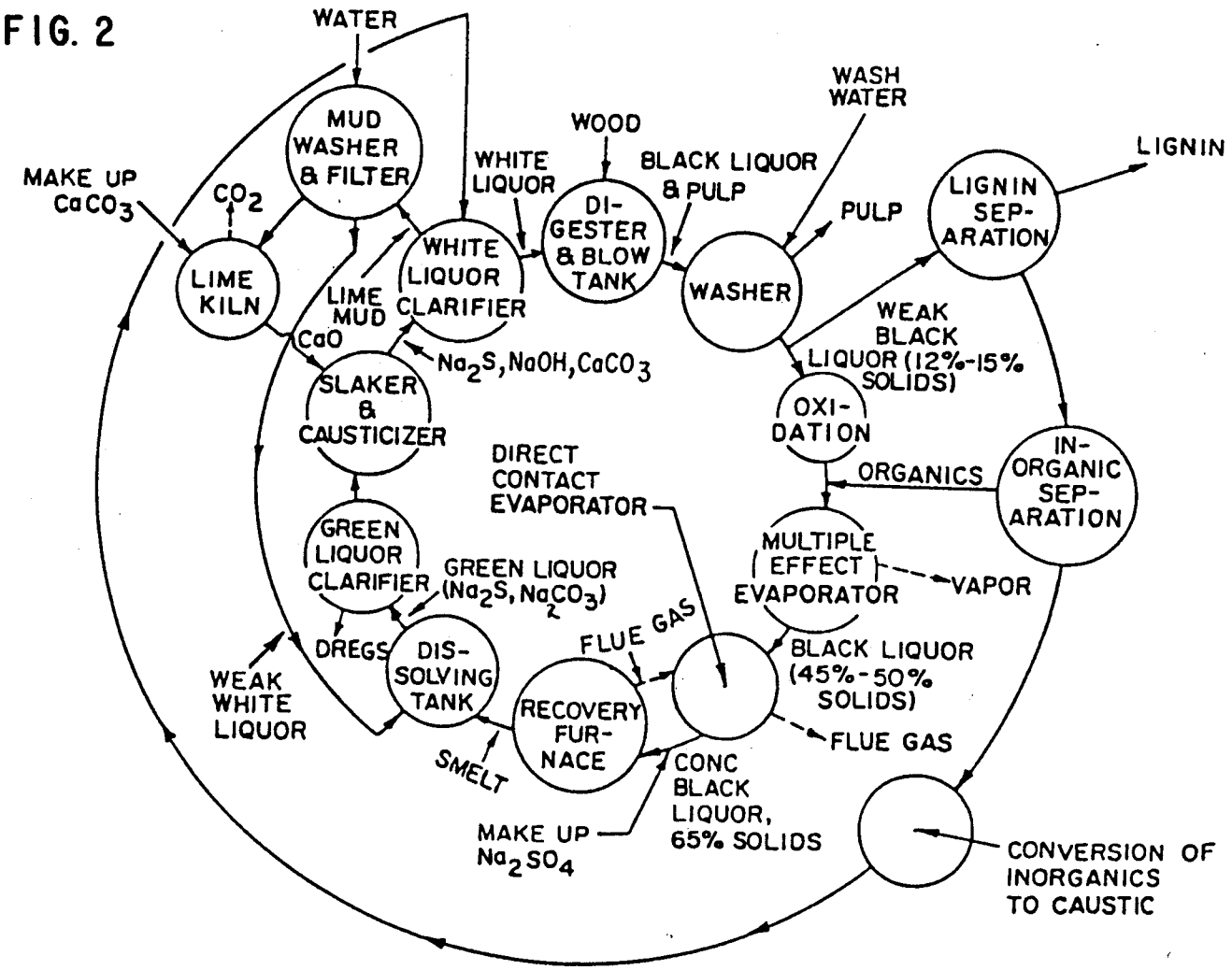
FIG. 2 illustrates a flow diagram of the present invention.

This concept is shown in FIG. 2, the Bypass Process. The economic advantages of this Bypass Process as shown in FIG. 2 will be appreciated by those skilled in the art. This invention allows the kraft black liquor to be converted to pulping chemicals by bypassing the recovery furnace. This is accomplished by a series of well known and established chemical reactions. One such reaction is where the sodium sulfate is reacted with calcium oxide to produce sodium hydroxide and calcium sulfate which is insoluble. The sodium hydroxide is a pulping chemical and calcium sulfate which is gypsum can be used as pigment or sold into commerce as a commodity chemical.

FIG. 2 showing the invention illustrates the lignin separation from the weak black liquor which passes to an inorganic separation. Organics from this step are channeled to the recovery furnace and inorganics go to a conversion station where conversion to caustic takes place. This material is then used in producing white liquor.

The choice of acid that is used to precipitate the kraft lignin may depend on the commercial value of the calcium anion. For instance if phosphoric acid is used, then calcium phosphate is produced which will separate and can be sold as a commercial fertilizer. If carbon dioxide is used, then sodium carbonate is produced which may be reacted with calcium oxide to produce sodium hydroxide, a pulping chemical.

The following examples illustrate the teachings of the present invention.

In the following examples, the exact amount of sodium in kraft black liquor will vary depending on the source of the kraft black liquor. In these examples, the principle is being demonstrated.

EXAMPLE I

The kraft lignin is removed by using various techniques (such as disclosed in U.S. Pat. No. 4,111,928) from 3,000 parts of weak kraft black liquor (approximately 15% solids). Sulfuric acid is used to acidify the kraft black liquor and the residual solution contains sodium sulfate. At this point, it is necessary to remove the sodium sulfate because it is necessary to maintain the proper sodium and sulfur balance in the system. The residual solution is concentrated to 50–60% solids and then this solution is allowed to cool to room temperature and the sodium sulfate readily crystallizes out and is easily separated from the solution by filtration or other appropriate method.

Once the sodium sulfate crystals are removed, the residual solution may be burned in the recovery furnace to recover the heat value of the organics that are present. One should note that the first crystallization may not remove all of the sodium sulfate. However, the amount of sodium sulfate that remains in solution . ay be tolerated by the system since most kraft pulp mills do add a certain amount of sodium sulfate directly to kraft recovery furnaces in order to maintain the sulfur balance in the system. The separated sodium sulfate may be sold to outside customers.

EXAMPLE II

The kraft lignin is removed by using various techniques (as above noted) from 3,000 parts of weak kraft black liquor (approximately 15% solids). Sulfuric acid is used to acidify the kraft black liquor and the residual solution contains sodium sulfate. At this point, it is necessary to remove the sodium sulfate because it is necessary to maintain the proper sodium and sulfur balance in the system. The residual solution is concentrated to 50–60% solids and then allowed to cool to room temperature and the sodium sulfate readily crystallizes out and is easily separated from the solution by filtration or some other appropriate method.

Once the sodium sulfate crystals are removed, the residual solution may be burned in the recovery furnace to recover the heat value of the organics that are present. One should note that the first crystallization may not remove all of the sodium sulfate. However, the amount of sodium sulfate that remains in solution may be tolerated by the system since most kraft pulp mills do add a certain amount of sodium sulfate directly to kraft recovery furnaces in order to maintain the sulfur balance in the system.

However, in order to utilize the sodium sulfate so that the sodium balance is maintained without adding outside sodium, the sodium sulfate may be converted to a caustic pulping chemical. Here 215 parts of sodium sulfate (anhydrous weight) are dissolved in 800 parts of water and then 84 parts of calcium oxide is added under agitation and the temperature of this mixture is heated to 180 F. for two hours or until the sodium sulfate is mostly converted into sodium hydroxide and the calcium oxide is precipitated as calcium sulfate. The calcium sulfate is filtered or separated by other means, and the solution that is left is a caustic solution that can be used for pulping. The separated calcium sulfate is a form of gypsum and may be used as a pigment for some paper coatings or sold to outside markets.

EXAMPLE III

In this example, phosphoric acid is used to acidify the kraft black liquor. The kraft lignin is removed by various techniques (as above noted) from 3,000 parts of weak black liquor (approximately 15% solids). Since phosphoric acid is used to acidify the kraft black liquor, then the residual solution will contain sodium phosphate. At this point, it becomes necessary to remove the sodium phosphate because it is necessary to keep the phosphate ion out of the system.

Then the residual solution is concentrated to 50 to 60% solids and at room temperature the sodium phosphate will readily crystallize out and is easily separated from the solution by filtration or some other appropriate method. Once the sodium phosphate is removed, then the residual solution may be burned in the recovery furnace to recover the heat value of the organics that are present. The separated sodium phosphate may be sold to outside customers.

EXAMPLE IV

In this example, phosphoric acid is used to acidify the kraft black liquor. The kraft lignin is removed by various techniques (as noted above) from 3,000 parts of weak black liquor (approximately 15% solids). Since phosphoric acid has been used to acidify the kraft black liquor the residual solution will contain sodium phosphate. At this point, it becomes necessary to remove the sodium phosphate because it is necessary to keep the phosphate ion out of the system.

The residual solution is then concentrated to 50 to 60% solids and at room temperature the sodium phosphate will readily crystallize out and can be easily separated from the solution by filtration or some other appropriate method. Once the sodium phosphate is removed, then the residual solution may be burned in the recovery furnace to recover the heat value of the organics that are present.

The separate sodium phosphate may be converted to calcium phosphate which is a valuable fertilizer. This is accomplished by concentrating the residual solution and allowing the sodium phosphate to crystallize out. This crystallized sodium phosphate (approximately 200 parts anhydrous), can be separated and then dissolved in 1,000 parts of water. Then 252 parts of calcium oxide is added under agitation and the temperature of this mixture is heated to 180 degrees F. for two hours or until the sodium phosphate is converted into sodium hydroxide and the calcium oxide is precipitated as calcium phosphate. The calcium phosphate may be filtered or separated by other means and the solution that is left is a caustic solution that may be used for pulping. The separated calcium phosphate can be sold as a fertilizer or to other markets.

EXAMPLE V

In this example, the kraft lignin is insolublized by using carbon dioxide gas.

Kraft lignin is removed by various techniques (as noted above) from 3,000 parts of weak black liquor (approximately 15% solids) after the carbon dioxide gas has been allowed to insolublize the kraft lignin by various techniques. At this point, the residual solution may be concentrated and burned in the kraft recovery furnace, or the residual solution could be concentrated to at least 50% solids so that the sodium carbonate or sodium bicarbonate will crystallize out and therefore be easily filtered or separated from the solution by various techniques.

Then 40 parts of sodium carbonate (anhydrous weight) is added to 500 parts of water in a suitable container. Then 22.4 parts of calcium oxide is added under agitation and the temperature of this mixture is heated to 18degrees F. for two hours or until the sodium carbonate is converted into sodium hydroxide and the calcium oxide is precipitated out as calcium carbonate.

In an actual kraft pulp mill, the sodium carbonate may be sent to a slacker and causticizer where this sodium carbonate will be converted into sodium hydroxide.

Under atmospheric pressure, carbon dioxide gas will not insolublize all of the lignin that is present in kraft black liquor. However, it is not necessary to remove all of the kraft lignin from the kraft black liquor. Sodium carbonate or sodium bicarbonate that is formed actually need not be removed from the solution since the recovery furnace is capable of processing these materials. However, since it is the intent of this invention to bypass the recovery furnace, the sodium carbonate and sodium bicarbonate may be removed prior to the recovery furnace and then added to the slacker and causticizer.

These are one of the major advantages of this new invention. It allows different materials to be used to derive the maximum value for its products and by-products. This new invention allows a kraft pulp mill to increase its production of pulp by as much as 20% or even higher without the huge capital investment for a recovery furnace.

This invention has been described in detail with particular emphasis on the preferred embodiments thereof, but it should be understood that variations and modifications within the spirit and scope of the invention may occur to those skilled in the art to which the invention pertains.

What is claimed is:

1. A process for use in the kraft pulping process which uses a recovery furnace and a wood digester including treating kraft black liquor from the wood digester to render all or part of the kraft lignin insoluble in the aqueous phase, removing the insoluble kraft lignin from the aqueous phase, processing the aqueous phase to separate inorganic chemicals contained therein, converting the inorganic chemicals into pulping chemicals and transporting the pulping chemicals to the digester to digest wood products, wherein the converting of the inorganic chemicals and the transporting of the pulping chemicals are accomplished without passing them through the recovery furnace.

2. A process as in claim 1 wherein the kraft black liquor from the wood digester is acidified to render the lignin insoluble in the aqueous phase.

3. A process as in claim 2 wherein said acidification is accomplished by the use of sulfuric acid.

4. A process as in claim 2 wherein said acidification is accomplished by the use of phosphoric acid.

5. A process as in claim 2 wherein said acidification is accomplished by the use of carbon dioxide.

6. A process as in claim 3 wherein the inorganic material that is separated is sodium sulfate.

7. A process as in claim 3 wherein the sodium sulfate is reacted with calcium oxide or calcium hydroxide to produce sodium hydroxide.

8. A process as in claim 5 wherein the inorganic material that is separated is sodium bicarbonate.

9. A process as in claim 8 wherein the sodium bicarbonate is converted into sodium carbonate.

10. A process as in claim 3 wherein the sodium sulfate is reacted with barium oxide or barium hydroxide to produce sodium hydroxide.

11. A process as in claim 2 wherein said acidification is accomplished by the use of sulfur dioxide.

12. A process as in claim 4 wherein sodium phosphate is reacted with calcium oxide or calcium hydroxide to produce calcium phosphate.

13. A process as in claim 1 wherein the aqueous phase remaining after the inorganic chemicals therein are separated is transported to the recovery furnace to be burned.

* * * * *